US005392708A

United States Patent [19]

Dorn

[11] Patent Number: 5,392,708

[45] Date of Patent: Feb. 28, 1995

[54] METHOD AND APPARATUS FOR HANDLING A PACKET OF PIECES CUT FROM A BAND

[75] Inventor: Michael Dorn, Frick, Switzerland

[73] Assignee: Textilma AG, Switzerland

[21] Appl. No.: 112,596

[22] Filed: Aug. 26, 1993

[30] Foreign Application Priority Data

Aug. 28, 1992 [CH] Switzerland ..... 02684/92

[51] Int. Cl.[6] ..... B30B 15/30

[52] U.S. Cl. ..... 100/215; 53/255; 53/529; 100/218; 100/226; 100/248

[58] Field of Search ..... 100/215, 218, 220, 247, 100/248, 252, 226; 53/255, 536, 529

[56] References Cited

U.S. PATENT DOCUMENTS

| | | | |
|---|---|---|---|
| 2,500,819 | 3/1950 | Hall et al. | 100/218 X |
| 2,996,859 | 8/1961 | Winkler et al. | 53/529 |
| 3,370,549 | 2/1968 | Livingston | 53/529 X |
| 3,412,843 | 11/1968 | Maulini . | |
| 3,608,269 | 9/1971 | Gore | 53/529 X |
| 3,766,706 | 10/1973 | Graham | 53/529 |
| 3,777,657 | 12/1973 | Crandlemire | 100/226 X |
| 4,056,919 | 11/1977 | Hirsch | 53/529 |
| 4,070,960 | 1/1978 | Diluiso et al. | 100/226 X |
| 4,123,970 | 11/1978 | Quante | 100/218 X |
| 4,141,193 | 2/1979 | Joa | 53/529 |

FOREIGN PATENT DOCUMENTS

| | | |
|---|---|---|
| 0084446 | 7/1983 | European Pat. Off. . |
| 0363323 | 4/1990 | European Pat. Off. . |
| 1275441 | 8/1968 | Germany . |
| 2153169 | 5/1973 | Germany . |
| 2542722 | 6/1976 | Germany . |
| 2719991 | 11/1978 | Germany . |
| 607979 | 12/1978 | Switzerland . |

*Primary Examiner*—Stephen F. Gerrity

[57] ABSTRACT

A packet, consisting of a stack of band sections lying parallel to one another, is formed in a magazine compartment. The packet is ejected by an ejecting apparatus onto the receiving table of a transfer apparatus. There it is compressed between holding members to a width B, which width is smaller than the corresponding internal measurement A of a mold, which mold is made of a base and side walls and which mold is open on its side opposite to the base. The mold is put over the packet and the packet is clamped within the mold, whereby the packet is made ready for further processing.

10 Claims, 1 Drawing Sheet

METHOD AND APPARATUS FOR HANDLING A PACKET OF PIECES CUT FROM A BAND

BACKGROUND OF THE INVENTION

The invention concerns a method and apparatus for handling a packet or stack of band sections.

U.S. Pat. No. 5,081,752 describes an apparatus with a weaving or knitting machine for manufacturing woven or knitted bands. In direct connection with the weaving or knitting machine the bands are cut into sections of definite length and are stacked into a magazine between parallel magazine walls above a foot ledge. In this way up to several hundred band sections may be stacked onto one another. The bonding of the band sections along their edges by means of gluing or welding directly in the magazine is possible. This however brings about various disadvantages. In particular, the application of adhesive directly onto the band sections inside the magazine leads, by diffusion of the adhesive along the textile fibers, to soiling of the magazine walls. Because of the adhesive application the production speed is considerably reduced. Moreover, the choice of types of adhesive material is limited.

SUMMARY OF THE INVENTION

The object of the invention is to provide a method and an apparatus of the above-mentioned kind which avoids the mentioned disadvantages.

The stated object is solved by a method for handling a packet of stacked band sections which are stacked in parallel relationship to one another in a magazine compartment. The packet is transferred into a mold having a base and side walls and an open side opposite the base. In the mold, the band sections are arranged in parallel relationship perpendicular to the base so that packets can be further processed while in the mold. Apparatus which carries out the process includes a transfer apparatus with a receiving table for receiving the packet from the magazine compartment and inserting the packet into the mold. An ejecting apparatus is also provided to eject the packet out of the magazine compartment to the transfer apparatus.

The method and the apparatus make it possible to remove the stacked band or sections arranged in an unbonded condition from the magazine and to place them into a mold, whereby a plurality of band sections are transportable as a packet. It is no longer necessary to process the packet of stacked parallel band sections within the magazine. Instead, the processing procedures can be carried out within a separate mold. Thereby, soiling of the magazine walls is prevented and many variations are possible in processing the stacked band sections, such as for example, drying, heating, coating, gluing, and the like, in a rational way in separate steps outside the magazine. Moreover, a wider choice of the adhesive materials is possible.

Basically, it is possible upon ejection to allow the packet to be free on the side opposite to the foot ledge. Of advantage is a development where the packet is covered by means of a head ledge. The orderly transfer of the packet to the transfer apparatus is facilitated by the construction of the apparatus.

For the transfer of the packet to and into the mold a construction of the apparatus using a retractable stop is of advantage. Practically, the packet is compressed before its insertion into the mold. The compression of the packet can take place in different ways; however, a development of the apparatus using the transfer apparatus is advantageous.

An especially secure transfer of the packet to the mold is achieved by a development of the apparatus using holding members to compress the packet before placement in the mold.

The mold can be placed perpendicularly to the receiving table over the packet held by holding members. It is, however, also possible to place the mold on the support table before the ejection of the packet, to remove the wall parts of the mold lying in the sliding path of the packet, and to laterally move the packet directly into the so opened mold.

The magazine can include several stationarily arranged magazine compartments to which on one hand the ejecting apparatus and the transfer apparatus can be slid and brought into registration with the magazine compartments. Advantageous, however, is a construction in which the ejecting apparatus and the transfer apparatus are stationary, and the magazine with its magazine compartments adjacent one another can be brought into registration with the ejecting apparatus and the transfer apparatus by sliding the whole magazine.

BRIEF DESCRIPTION OF THE DRAWINGS

Embodiments of the invention are described in more detail below in connection with the drawings, which show.

DESCRIPTION OF THE PREFERRED EMBODIMENTS

Figure 1:
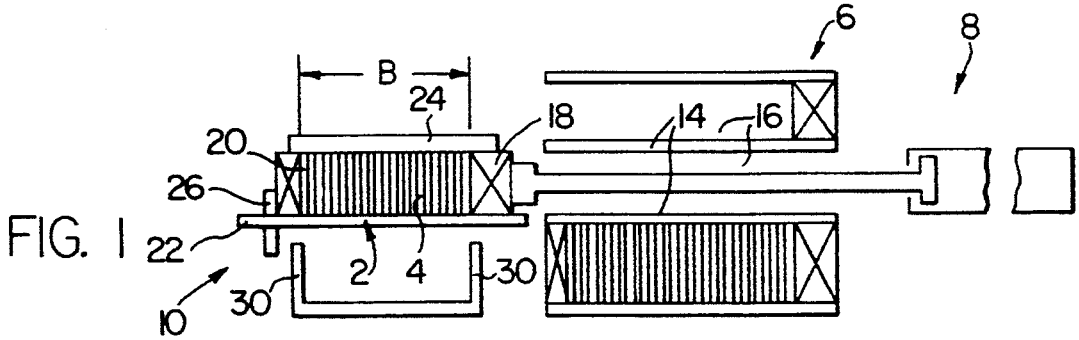
- FIG. 1 - an apparatus with a packet ejected from a magazine, in side view.
Figure 2:
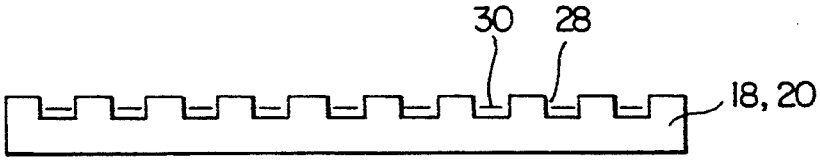
- FIG. 2 - a foot or head ledge for the packet in plan view.
Figure 3:
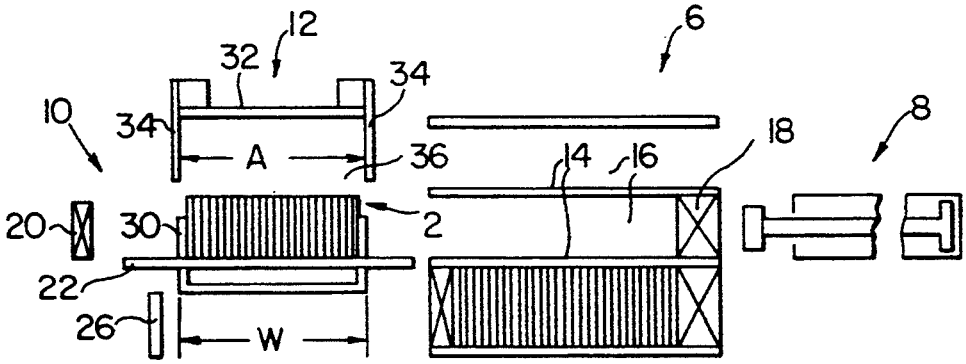
- FIG. 3 - the apparatus of FIG. 1 before the application of the mold.

FIGS. 1, 2 and 3 show an apparatus for transporting a packet 2 of stacked, parallel band sections 4 from a magazine 6 by means of an ejecting apparatus 8 to a transfer apparatus 10 for transfer to a mold 12.

The magazine 6, which for example can be part of the apparatus shown in U.S. Pat. No. 5,081,752, consists of different magazine compartments 16 formed by magazine walls 14, which compartments are movable vertically up and down and can be brought into registration with the ejecting apparatus 8 and the stationary apparatus 10. To stack the band sections 4 the magazine compartments 16 are originally directed vertically, as is illustrated in U.S. Pat. No. 5,081,752. Foot ledges 18 form the base of the magazine compartments. These foot ledges 18 can be brought into engagement with the ejecting apparatus 8. This ejecting apparatus can, for example, be a fluid actuated piston/cylinder unit. On its side opposite the foot ledge 18 the packet 2 is provided with a head ledge 20, which after completion of the packet is applied to the magazine compartment by hand or machine. For the ejection of the packet, the magazine is pivoted to the horizontal position as shown in the figures.

The packet 2 is ejected from the magazine 6 to the transfer apparatus 10 as illustrated in FIG. 1. The transfer apparatus has a receiving table 22 which corresponds with the magazine wall 14 of the magazine compartment. Parallel to the receiving table 22 is a withdrawable guide apparatus 24, whose spacing from the receiving table 22 corresponds generally to the thickness of the packet 2. The receiving table 22 is equipped with a withdrawable or retractable stop 26 in the sliding path of the packet and which stops the head ledge 20 upon the ejection of the packet 2. By means of the ejecting device 8 the packet 2 can now be compressed, to a width B, which is smaller than the corresponding internal measurement A of the mold 12. The foot ledge 18 and the head ledge 20 are each provided with recesses 28 distributed over their lengths and into which upon the compression of the packet 2 comb-like holding members 30 can be inserted from the base of the receiving table 22. The outer spacing W of the holding members is smaller than the corresponding internal measurement A of the mold. The holding members 30 hold the packet in its compressed form, so that the stop 26 can be withdrawn, the head ledge 20 can be removed, and the foot ledge 18 can again be withdrawn by means of the ejecting apparatus 8. This condition is illustrated in FIG. 3.

The mold 12 has a base 32 and side walls 34 and is open at the side 36 opposite to the base 32, as can be seen in FIG. 3. After withdrawal of the guide apparatus 24, the mold 12 is brought over the packet 2, which is held only by the holding members 30, is placed over the packet, and is brought to rest on the receiving table 22. Thereupon the holding members 30 can again be withdrawn whereupon the packet expands against the side walls 34 and is held in the mold 12. With this secure alignment of the band sections 4 in the mold 12 the packet can be delivered together with the mold 12 to a further apparatus for further processing, for example coating. Thereupon the receiving table 22 is free to receive a new packet.

Figure 4:
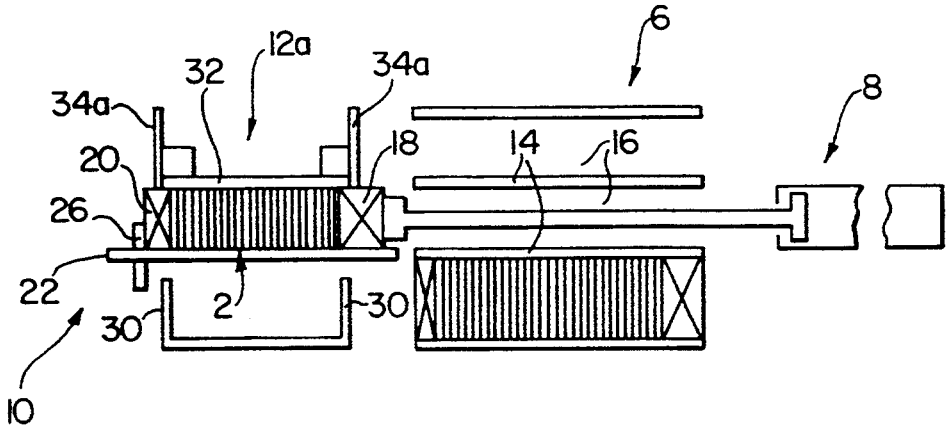
- FIG. 4 - the apparatus of FIG. 1 with a modified mold.
Figure 5:
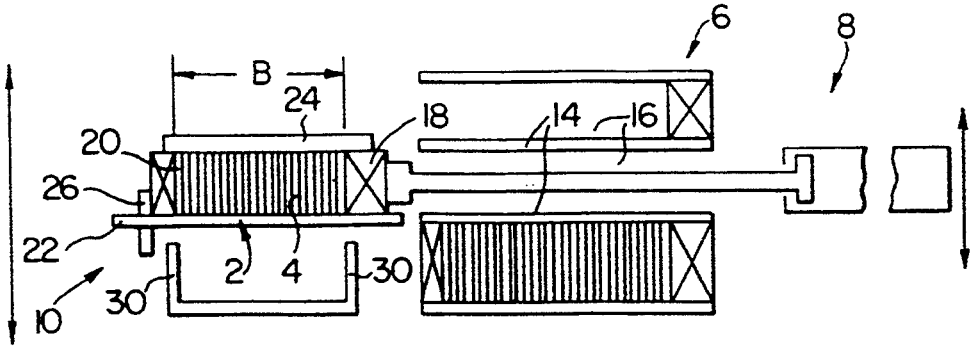
- FIG. 5 - an alternative embodiment of the present invention of an apparatus with a packet ejected from a magazine, in side view.

FIG. 4 shows a modified embodiment of the apparatus with respect to the mold 12*a*, whose side walls 34*a* lying in the sliding direction are withdrawable or capable of being folded, until they are at least flush with the base 32 of the mold 12*a*. In this embodiment the mold 12*a* can be directly brought to the receiving table 22 of the apparatus and the packet 2 can be directly moved into the mold 12*a*. The base 32 of the mold 12*a* then serves at the same time as a guiding device. As in the case of FIGS. 1 and 2 the ejection again brings the packet 2 against the stop 26, so that the packet 2 is compressed between the head ledge and the foot ledge 12 and is held by the comb-shaped holding members 30. Thereupon the stop 26 can be withdrawn, and the head ledge 20 and the foot ledge 18 are removed. Now the side walls 34*a* are moved downwardly, whereupon the holding members 30 are withdrawn and the packet 2 expands against the side walls 34*a*. After this the mold 12a filled with the packet 2 can be removed and the apparatus is ready for the ejection of a new packet.

In contrast to the illustrated embodiments the magazine 10 can also be stationary and the ejecting device as well as the transfer apparatus can be movable along the length of the magazine and be brought into registration with the individual magazine compartments 16.

The band sections are in general manufactured by the weaving or knitting machine within nearly similar widths. The width of the band sections is determined according to the application of the later products. In the case of carpet panels being the end product, the widths are preferably between 8 mm and 30 mm. Other widths are, however, readily possible. The length of the band sections is likewise dependent on the application requirements. For carpet panels it lies preferably between 50 cm and 120 cm.

I claim:

1. An apparatus for transferring a packet of stacked band sections into a mold, wherein the packet is arranged in a magazine compartment between two magazine walls disposed perpendicular to the plane of the band sections, said magazine compartment including a foot ledge forming the base of the magazine compartment and lying parallel to the band sections, characterized by:

said mold having a base, side walls and an internal measurement A between the side walls, which mold is open on its side lying opposite to the base;

a transfer apparatus with a receiving table for receiving the packet from the magazine compartment and for inserting the packet into the mold; and an ejecting apparatus for ejecting the packet perpendicularly to the foot ledge out of the magazine and into the transfer apparatus.

2. An apparatus according to claim 1, characterized in that the packet has an associated head ledge which rests against the packet on the side facing away from the foot ledge when the packet is arranged in the magazine compartment.

3. An apparatus according to claim 2, wherein the ledges on the sides facing the packet each have recesses distributed over the length of the ledge and running perpendicularly to the ledge, and wherein the transfer apparatus includes holding members insertable at the transfer apparatus into the recesses in order to hold the packet in stable condition upon removal of the ledges by the electing-apparatus and upon application of the mold by the transfer apparatus., the outer spacing W of the holding members being smaller than the corresponding internal measurement A of the mold.

4. An apparatus according to claim 3, characterized in that the mold is placed perpendicularly, to the receiving table over the packet held by the holding members.

5. An apparatus according to claim 1 characterized in that the transfer apparatus includes a guide apparatus positioned above the receiving table, which guide apparatus is movable into and out of engagement with the packet received by the receiving table.

6. An apparatus according to one of claim 1, characterized in that the path along which the packet moves from the ejecting apparatus in the ejecting direction is limited at the transfer apparatus by a withdrawable stop.

7. An apparatus according to one of claim 1, characterized in that the packet is compressed by the ejecting apparatus at the transfer apparatus to a width B which is smaller than the corresponding internal measurement A of the mold.

8. An apparatus according to one of claim 1, characterized in that the mold is placable on the receiving table before the ejection of the packet, with the wall parts of the mold which lie in the ejection path of the packet being designed so as to be removable from the path.

9. An apparatus according to one of claim 1, characterized in that the ejection apparatus and the transfer apparatus are moveable; and the magazine has a number of magazine compartments with which the movably built ejection apparatus and transfer apparatus can be engaged.

10. An apparatus according to one of claim 1, characterized in that the ejection apparatus and the transfer apparatus are arranged in stationary relationship; and the magazine has a number of magazine compartments which are movable and can be brought for use to the stationary ejecting apparatus and transfer apparatus.

* * * * *